US005494093A

United States Patent [19]

Eiterman

[11] Patent Number: 5,494,093

[45] Date of Patent: Feb. 27, 1996

[54] ROLLING DOOR STOP APPARATUS

[75] Inventor: Alvin R. Eiterman, Amlin, Ohio

[73] Assignee: Wayne-Dalton Corp., Mt. Hope, Ohio

[21] Appl. No.: 259,710

[22] Filed: Jun. 14, 1994

[51] Int. Cl.[6] ..... E06B 9/56

[52] U.S. Cl. ..... 160/300; 49/322

[58] Field of Search ..... 160/300, 301, 160/302, 303, 296, 291, 7, 8, 9; 49/322; 188/82.1, 82.7, 82.77; 192/116.5,. 139, 140; 74/575, 577 R, 577 S

[56] References Cited

U.S. PATENT DOCUMENTS

| | | | |
|---|---|---|---|
| 2,869,183 | 1/1959 | Smith | 20/19 |
| 3,842,892 | 10/1974 | Stieler | 160/133 |
| 4,112,996 | 9/1978 | Föhl | 160/296 |
| 4,125,142 | 11/1978 | Föhl | 160/291 |
| 4,604,828 | 8/1986 | Baarse | 49/322 |
| 4,704,914 | 11/1987 | Horng | 74/411.5 |
| 4,848,522 | 7/1989 | Wolf | 188/71.2 |

OTHER PUBLICATIONS

N F B Getriebe–Und Tortechnik GmbH Publication.

*Primary Examiner*—David M. Purol

*Attorney, Agent, or Firm*—Renner, Kenner, Greive, Bobak, Taylor & Weber

[57] ABSTRACT

A stop mechanism (40) for a rolling door system (10) having a drive shaft (16) connecting a roll cylinder (15) carrying door slats (12) and a power system (20), including a stator ring assembly (45) mounted coaxially of the drive shaft, a plurality of circumferentially-spaced slots (48) positioned on the radially inner surface (47) of the stator ring assembly, a generally cylindrical rotor (56) mounted within the stator ring assembly for rotation with the drive shaft, a cutout 65 in the rotor, a pivot 70 on the rotor, a stop dog (81) mounted on the pivot for rotation thereon responsive to centrifugal force created by rotation of the rotor, an axial projection (90) on the stop dog configured to engage the cutout at one rotational limit of the stop dog where the stop dog effects locking engagement with a slot, whereby the stop dog transmits stopping forces from the stator ring assembly to the rotor.

20 Claims, 4 Drawing Sheets

ROLLING DOOR STOP APPARATUS

TECHNICAL FIELD

The present invention relates generally to stop apparatus for rolling doors. More particularly, the present invention relates to stop apparatus which is operative to preclude the uncontrolled fall of a rolling door. More specifically, the present invention relates to a stop device which senses descent of a rolling door at a velocity in excess of a pre-established operational speed and immediately engages the door, stops its further descent, and locks it in place until positive steps are taken to effect release.

BACKGROUND ART

Various types of rolling doors have long been used, particularly in regard to commercial and industrial buildings. Basically, rolling doors consist of a curtain of articulated slats which can be raised and lowered to selectively open and close a doorway or other opening in a building. The curtain is rolled and unrolled from some type of roll cylinder which is mounted horizontally adjacent the top of the doorway. This is a major advantage of rolling doors in that the door does not extend inwardly into the building from the doorway, as is the case with overhead doors which have a plurality of articulated panels which require tracks extending into a building for storing a door when it is in the open position. Of course, this characteristic of overhead doors restricts utilization of overhead space in a building having an overhead door in the area occupied by the tracks for the door panels.

Rolling doors conventionally have compensating systems to counterbalance the weight of the articulated curtain and any attachments thereto. Such counterbalancing systems normally employ a torsion spring or other biasing element which may be mounted within the roll cylinder. The roll cylinder is normally mounted on a drive shaft which may be powered by a drive system consisting of a motor and gear reducer coupled by a drive chain to a sprocket nonrotatably mounted relative to the drive shaft.

A potential for damage to the system or injury to operating personnel exists in the event of failure of certain components of rolling door systems. For example, in the event of a broken counterbalance spring, a broken roller chain, or a power failure or reduction of voltage to the electric motor, the door may be released in such a fashion that it undergoes a free fall. As rolling doors are frequently constructed of relatively heavy materials, there is the possibility of extensive damage to the door slats or other system components, not to mention damage to property or persons located in or proximate to the door opening at the time of such a free fall.

Since the possibility of component or power failures and the resultant free fall consequences have been appreciated in the industry for some time, efforts have been made to develop different types of stop mechanisms for rolling doors. In many instances, the existing stop mechanisms tend to be over sophisticated, variable in operation, or have other disadvantageous operation or maintenance characteristics.

One type of device which has appeared in the industry employs cammed sprags that are pushed away from their housing by the power input mechanism of the stop device. Rotation from the output side of such stop mechanisms, as by a spring imbalance or failure, is prevented by the sprags locking against the housing. In some instances, stop mechanisms of this type can experience problems with repeat locking and unlocking and thus, provide erratic operation due to spring imbalance or other minor intermittent variations in resistance provided by movement of the door. In addition, stop mechanisms of this type may have highly critical tolerances and may require that support bearings be used at both ends to insure that no bending is introduced via the shaft to avoid lockups being artificially triggered.

Another type of device which is used as a stop mechanism for rolling doors employs roller or ball bearings which are positioned in pockets in the centrally disposed rotor during normal operation. When excessive angular velocity of the rotor attached to the drive shaft takes place, the ball bearings are thrown outwardly into recesses formed in the stationary ring surrounding the rotor with the configuration of the ring and the slots for the balls being arranged in such a manner as to trap or jam the ball bearings between the rotor and the stationary ring to thereby effect stopping and locking of the stop mechanism. Stop mechanisms of this type may exhibit a lack of uniformity with respect to the extent of rotation which takes place before jamming or locking may occur. Another problem with stop mechanisms of this type is that component replacement or factory servicing may be necessary or desirable after each actuation of the locking mechanism. Besides the operational disadvantages noted above and the potential for frequent service, the existing devices tend to be expensive and frequently not sufficiently rugged to withstand the use and abuse to which such stop mechanisms and rolling doors are routinely submitted.

DISCLOSURE OF THE INVENTION

Therefore, an object of the present invention is to provide a stop mechanism for rolling doors which is adapted for use with various types and sizes of rolling doors that are currently manufactured or are commonly in use in the industry. Another object of the present invention is to provide such a stop mechanism which is relatively noncomplex and inexpensive compared to conventional stop mechanisms that have heretofore been available in the industry. A further object of the present invention is to provide such a stop mechanism which eliminates many of the disadvantages of various stop mechanisms that have been employed in the industry.

Another object of the present invention is to provide a rolling door stop mechanism which has a minimum of moving parts such as to reduce the possibilities of component or system failure when the mechanism is actuated. Yet another object of the present invention is to provide such a stop mechanism which employs only a single heavy-duty stop dog or pawl member attached to a rotor associated with the rolling door drive shaft to sense a condition wherein the angular velocity of the drive shaft exceeds a predetermined value, such that the stop dog is actuated by centrifugal force to move from its normal operating position to the locking position to stop the descent of the rolling door. Yet a further object of the present invention is to provide such a stop mechanism wherein only the single stop dog, which is a pivotally-mounted member, moves to effect positioning between the rotor and stator or stationary member, such that the stopping and locking forces are transmitted directly from the stator to the rotor through the stop dog member.

Another object of the present invention is to provide a rolling door stop mechanism which may be readily adjusted to accommodate operational characteristics of various types of doors or to accommodate operational peculiarities or changes in operational characteristics of a particular door during the course of its operational life. Yet another object of the present invention is to provide such a stop mechanism which remains in the locked position after actuation until the system failure can be repaired and positive steps are taken to effect release of the stop mechanism.

In general, the present invention contemplates a stop mechanism for a rolling door system having a drive shaft connecting a roll cylinder carrying door slats and a power system, including a stator ring assembly mounted coaxially of the drive shaft, a plurality of circumferentially-spaced slots positioned on the radially inner surface of the stator ring assembly, a generally cylindrical rotor mounted within the stator ring assembly for rotation with the drive shaft, a cutout in the rotor, a pivot on the rotor, a stop dog mounted on the pivot for rotation thereon responsive to centrifugal force created by rotation of the rotor, an axial projection on the stop dog configured to engage the cutout at one rotational limit of the stop dog where the stop dog effects locking engagement with a slot, whereby the stop dog transmits stopping forces from the stator ring assembly to the rotor.

PREFERRED EMBODIMENT FOR CARRYING OUT THE INVENTION

Figure 1:
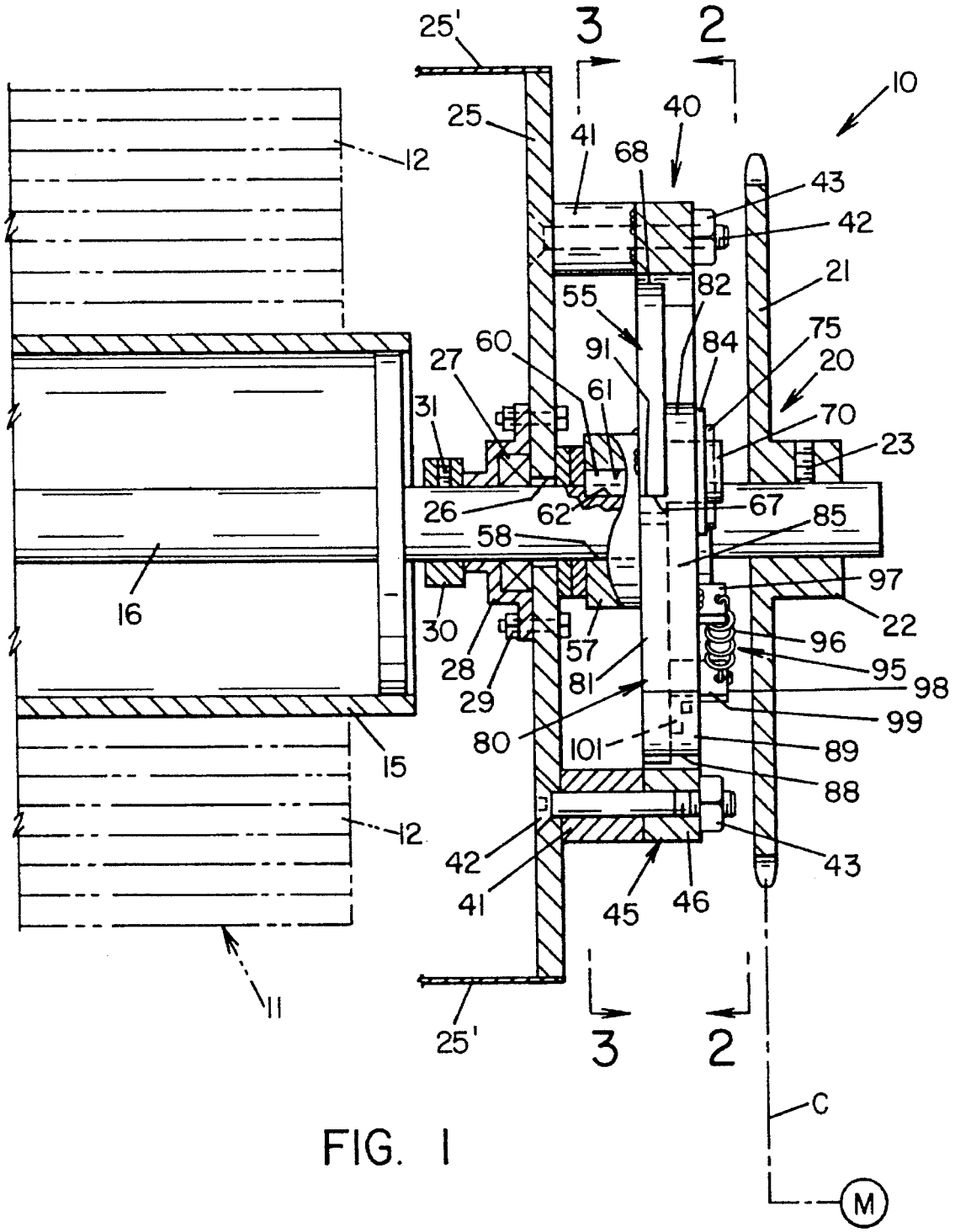
FIG. 1 is a front elevational view of a stop mechanism according to the concepts of the present invention shown in exemplary operative relationship with partially schematic depictions of a rolling door, a roll cylinder, a door bracket, a power system, and a drive shaft interconnecting all of the system elements.

An exemplary rolling door system embodying the concepts of the present invention is generally indicated by the numeral 10. The rolling door system 10 shown includes a conventional, schematically-depicted door generally indicated by the numeral 11. In standard fashion, the door 11 consists of a plurality of relatively narrow slats 12 which extend horizontally the full length of a door opening. The slats 12 are joined at their lateral extremities to adjacent slats 12 at pivot joints 13 to permit articulation between all adjacent slats 12. As a result, the door 11 may be rolled onto and off of a roll cylinder or barrel 15 to effect opening and closing of the door 11. It will be appreciated that the slats 12, due to their articulation at pivot joints 13, may be positioned in layers on roll cylinder 15 as the door 11 is opened upwardly and payed out vertically downwardly from the layered position as the door 11 is closed.

The roll cylinder 15 is attached to a drive shaft 16 for rotation therewith. The roll cylinder 15 may also house a torsion spring assembly (not shown) in conventional fashion, which interacts with the drive shaft 16 in a known manner to provide a progressively increasing torsional force to the drive shaft 16 as the door 11 is lowered and a progressively decreasing force as the door 11 is raised, thereby counterbalancing the weight of the door 11 as it is closed and opened. The lowest slat 12 of door 11 may be provided with a weighted bottom piece 14 which operates to stabilize the door 11 during raising and lowering operations and seat on a pad or the ground proximate a door opening in a building.

The drive shaft 16 is actuated to rotate roll cylinder 15 to open and close the door 11 by a power system, generally indicated by the numeral 20. The power system 20 includes a sprocket 21 that has a hub 22 with a set screw 23 which maintain the sprocket 21 in a selected position axially of drive shaft 16 and affixed thereto to preclude relative rotation with respect to drive shaft 16. In conventional fashion, the sprocket 21 is connected by a drive chain C to a combined gear reducer and reversible motor M. The gear reducer and reversible motor M may be provided with standard controls (not shown) to effect bidirectional rotation of sprocket 21 and stopping at any desired position in a manner well known to persons skilled in the art.

Drive shaft 16 is supported axially outwardly of the ends of roll cylinder 15 by door end plate brackets, generally indicated by the numeral 25. The door end plate brackets 25 are configured to span the entirety of roll cylinder 15, with the door 11 rolled thereabout in the open position thereof. The door end plate brackets 25 may support a cover 25' which forms a housing for door 11 and roll cylinder 15, except for a downward opening 24, which permits passage of door 11 as it is raised and lowered. The door end plate brackets 25 and cover 25' are conventionally attached to a building proximate the upper extremity of an opening in the building on which rolling door system 10 is mounted.

The door end plate brackets 25 have a generally central bore 26, which is adapted to receive the drive shaft 16. The drive shaft 16 is supported in the bores 26 for free rotation relative to the door end plate brackets 25 by bearings 27 supported in a bearing housing 28. As shown, the bearing housing 28 is attached to the door end plate bracket 25 as by machine screws 29 or other appropriate fasteners. A locking collar 30 may be provided on the drive shaft 16 axially outwardly of the bearing housing 28. The locking collar 30 is maintained in position on drive shaft 16 as by a set screw 31. It will thus be appreciated that the drive shaft 16 carrying roll cylinder 15 and driven by power system 20 is thereby mounted for free rotation relative to the door end plate brackets 25 positioned proximate each axial extremity of the roll cylinder 15.

Figure 2:
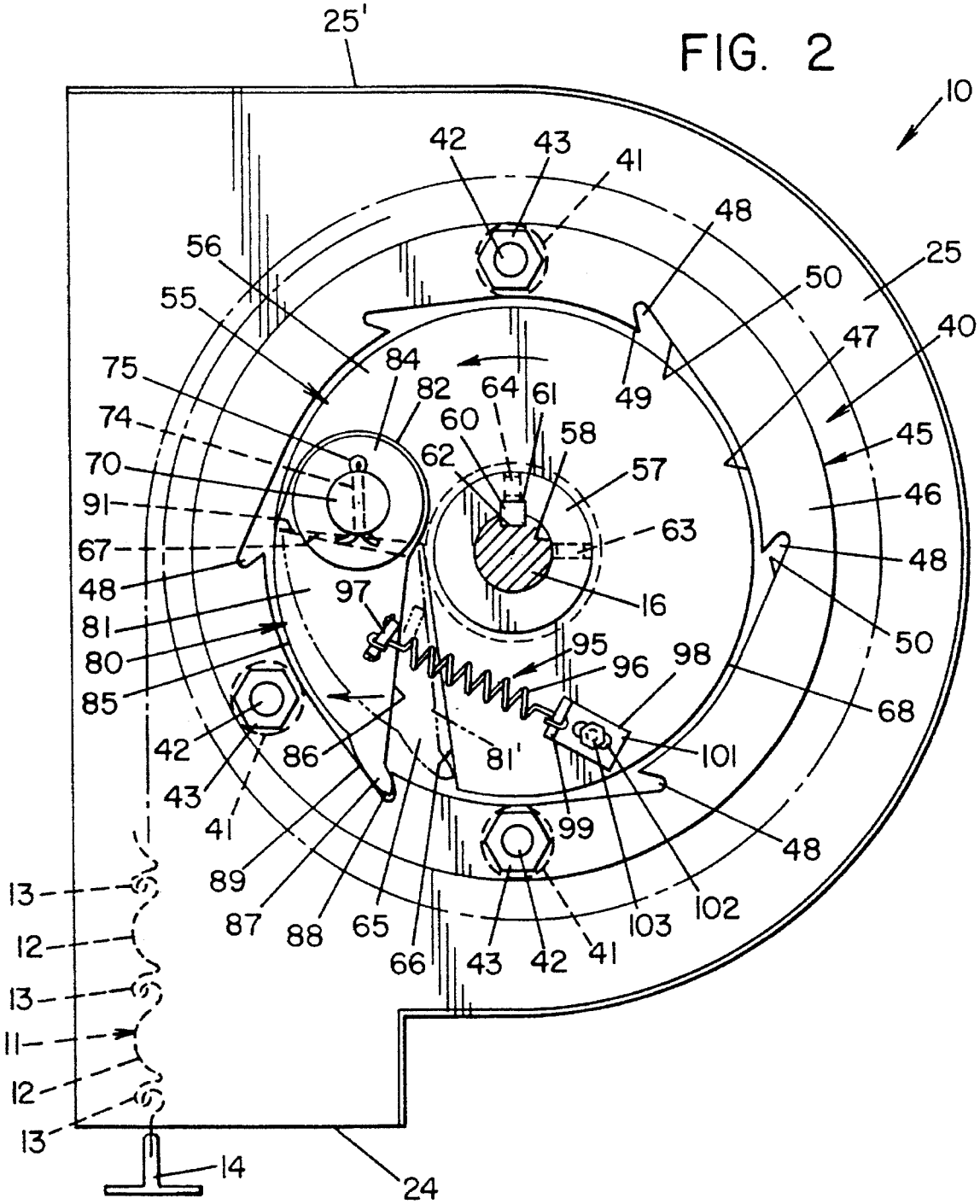
FIG. 2 is an enlarged cross-sectional view taken substantially along the line 2—2 of FIG. 1 and showing details of the front of the stop mechanism.
Figure 3:
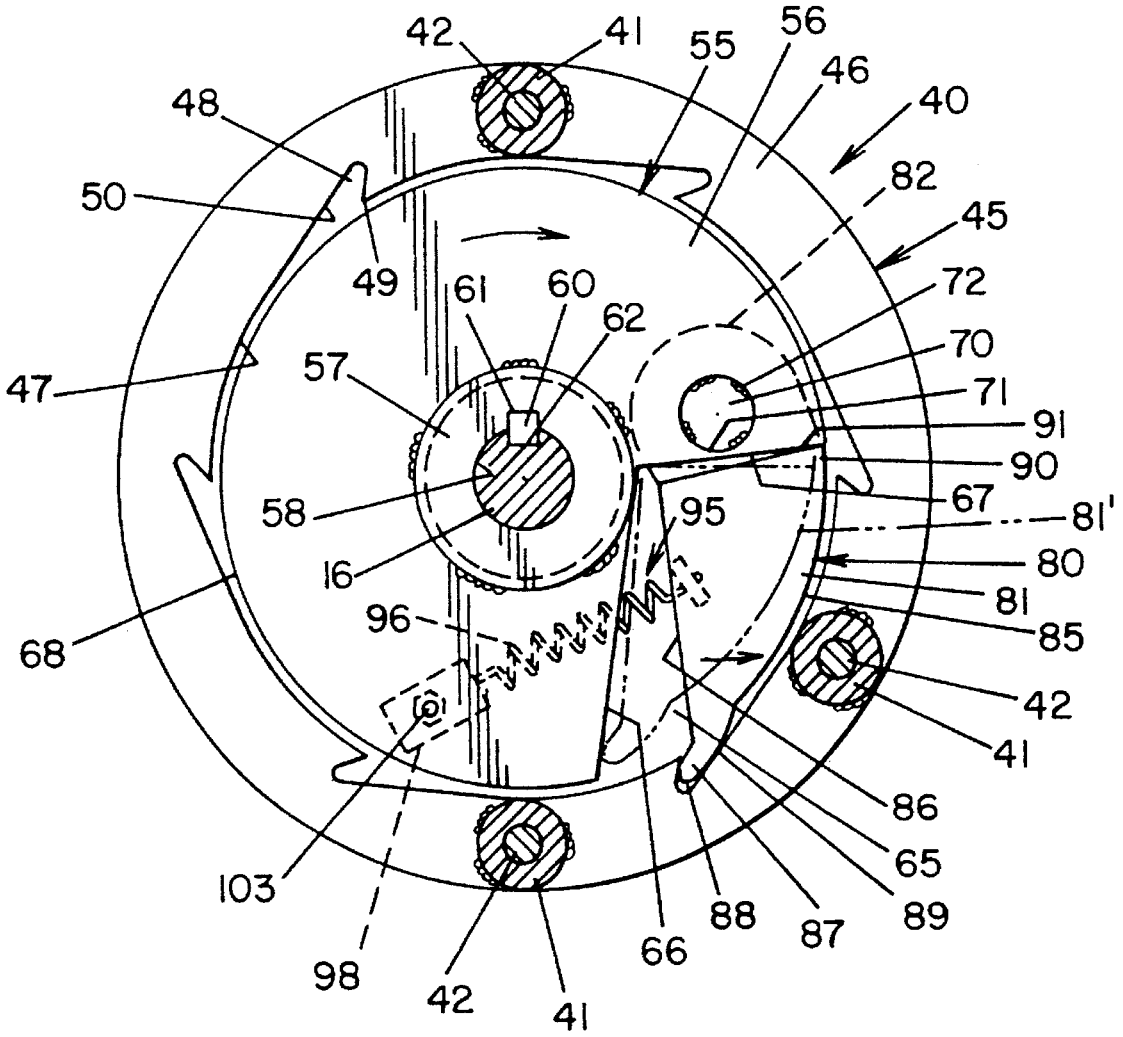
FIG. 3 is an enlarged cross-sectional view taken substantially along the line 3—3 of FIG. 1 and showing details of the rear side of the stop mechanism.
Figure 4:
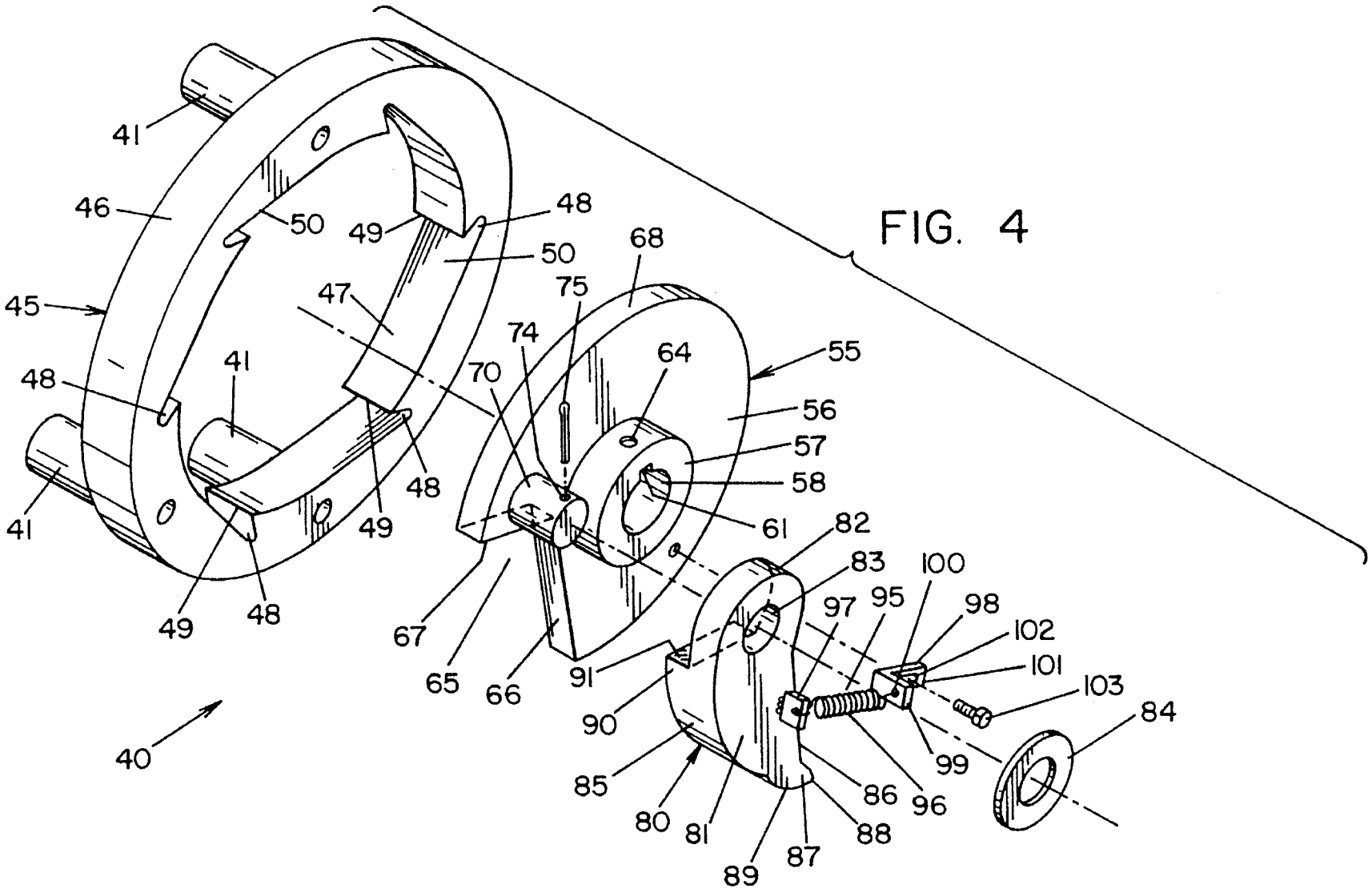
FIG. 4 is an exploded perspective view of the stop mechanism of FIG. 1 showing details of and the operative interrelationship between the various components.

Positioned preferably axially outwardly of one of the door end plate brackets 25 is a stop mechanism 40 according to the concepts of the present invention. The stop mechanism 40 has as the primary fixed element thereof a stator ring assembly, generally indicated by the numeral 45. The stator ring assembly 45 has as the primary component thereof a generally annular ring 46 centered about drive shaft 16. The annular ring 46 is positioned in selective spaced relation to door end plate bracket 25, as by a plurality of cylindrical standoffs 41. As seen in FIG. 3, there are three circumferentially-spaced cylindrical standoffs 41 shown for exemplary purposes. The cylindrical standoffs 41 and the stator ring assembly 45 may be affixed to the door end plate bracket 25 by suitable bolts 42 and nuts 43, as best seen in FIGS. 1–3. The stator ring assembly 45 is thus mounted in a fixed position spaced from the door end plate bracket 25 in coaxial relation to the drive shaft 16.

The annular ring 46 has a generally cylindrical radially inner surface 47. The inner surface 47 of annular ring 46 is provided with a plurality of circumferentially-spaced, U-shaped slots 48 formed in the annular ring 46. The U-shaped slots 48 extend radially outwardly of the cylindrical radially inner surface 47 of annular ring 46. The U-shaped slots 48 preferably extend the entire axial width of the annular ring 46 and are positioned at an angle to a direct radial orientation with respect to annular ring 46, such as to form return lips 49 for a purpose to be described hereinafter. Circumferentially displaced to the other side of the U-shaped slots 48 from the return lips 49 are ramps 50 formed in the inner surface 47 of annular ring 46. The ramps 50 smoothly merge into the U-shaped slots 48 and extend the full axial extent of the inner surface 47. As shown, the ramps 50 are preferably substantially linear and are oriented substantially tangentially to the inner surface 47.

As shown, there are six of the U-shaped slots 48 positioned circumferentially equiangularly about the annular ring 46. As will be noted, each of the U-shaped slots 48 is bounded on one circumferential extremity by a return lip 49 and at the other circumferential extremity by a ramp 50. With the six U-shaped slots 48 depicted, it will be appreciated that their placement is at 60-degree intervals about inner surface 47 of annular ring 46. It is, however, to be understood that more or less of the U-shaped slots 48 could be employed, depending upon the operational requirements of a particular rolling door system 10.

The stop mechanism 40 has as the movable member associated with drive shaft 16 a rotor assembly, generally indicated by the numeral 55. The rotor assembly 55 includes a generally circular rotor plate 56 which is positioned on the drive shaft 16 and within the stator ring assembly 45 for selective operative interrelation between rotor assembly 55 and stator ring assembly 45. The rotor plate 56 has a cylindrical hub 57 which axially projects a distance in either direction from rotor plate 56. The cylindrical hub 57 has a central bore 58 for receiving the drive shaft 16. The cylindrical hub 57 is affixed to drive shaft 16 for rotation therewith by virtue, of a key 60 positioned in key ways 61 and 62 in cylindrical hub 57 and drive shaft 16, respectively. The cylindrical hub 57 and thus rotor plate 56 are maintained in fixed axial position relative to drive shaft 16 as by set screws 63 and 64. As shown, the set screws 63 and 64 extend radially through the cylindrical hub 57 to engage the drive shaft 16 and the key 60, respectively. It will thus be appreciated that the rotor plate 56 is both rotationally and axially fixed on the drive shaft 16 for rotation therewith within the stator ring assembly 45.

The cylindrical continuity of the rotor plate 56 is interrupted in a portion of one quadrant thereof by a pie-shaped cutout 65 forming a first limit stop 66 and a second limit stop 67 circumferentially displaced about the rotor plate 56 from first limit stop 66.

The rotor assembly 55 has a stub shaft 70 extending from the face of the rotor plate 56. The stub shaft 70 may be positioned in a bore 71 in rotor plate 56 and fixed therein as by welds 72 (FIG. 3). The stub shaft 70 is provided proximate its axially extending extremity with a diametrically positioned through bore 74 adapted to receive a cotter pin 75 for a purpose to be hereinafter detailed. As shown, the stub shaft 70 is located approximately one-half of the radial distance between the cylindrical hub 57 and the radially outer surface 68 of the rotor plate 56. Stub shaft 70 is positioned circumferentially of rotor plate 56 in a position proximate to but spaced from the pie-shaped cutout 65 and particularly the second limit stop 67 thereof.

The rotor assembly 55 carries a pawl mechanism, generally indicated by the numeral 80, to selectively effect locking engagement of rotor assembly 55 with stator ring assembly 45 as a function of the angular velocity of the rotor assembly 55 as established by the drive shaft 16. The pawl mechanism 80 consists of a generally teardrop-shaped stop dog 81. The stop dog 81 has a substantially circular end portion 82 which is provided with a central through bore 83. The through bore 83 is sized to accommodate the stub shaft 70 and provide a precise but loose running fit thereon. The stop dog 81 is axially restrained on stub shaft 70 by a washer 84 and by the cotter pin 75 positioned axially outwardly thereof. Thus, the stop dog 81 is freely pivotally mounted but axially restrained on the stub shaft 70.

The stop dog 81 has a curved surface 85 and a linear surface 86 extending from the circular end portion 82 in converging relation to a tip 87. The tip 87 preferably has a somewhat rounded extremity 88. As shown, the curved surface 85 is substantially circular and preferably has a radius substantially equal to the radius of the rotor plate 56. A portion of curved surface 85 in the area of tip 87 and leading to rounded extremity 88 may have a curved contact surface 89 of a substantially lesser radius than the curved surface 85. It will thus be appreciated that the curved contact surface 89 is particularly adapted to engage a ramp 50 of stator ring assembly 45 when the stop dog 81 moves to the solid-line position depicted in FIGS. 2 and 3, with the tip 87 of stop dog 81 extending into one of the slots 48. Rounded extremity 88 of tip 87 and curved contact surface 89 are significant in preventing damage to the contacting components when the stop dog 81 moves from the normal chain-line position 81' to the locking position depicted in solid lines.

It is to be noted that the stop dog 81 pivotally moves about stub shaft 70 from the normal chain line position 81' to the locking position 81 depicted in solid lines. In the normal chain line position 81', the rounded extremity 88 of tip 87 is in engagement with the first limit stop 66 of cutout 65 as one rotational limit of stop dog 81. The stop dog 81 has an axial projection 90 in the portion below the circular end portion 82, which may extend throughout the tip 87 and which projects into the cutout 65 of rotor plate 56. The axial projection 90 forms an axial lip 91 as to which a portion thereof engages second limit stop 67 of cutout 65 when the stop dog 81 reaches its rotational limit when the tip 87 of stop dog 81 is positioned in a slot 48, as depicted in solid lines in the drawings. Significantly, with this arrangement, the stopping forces applied to the stop dog 81 by tip 87 engaging a slot 48 are transmitted directly through stop dog 81 to the rotor plate 56 by virtue of the lip 91 being in engaging contact with second limit stop 67 of cutout 65. As a result, the abrupt stopping forces applied to stop dog 81 by the stator ring assembly 45 are transmitted directly therethrough to the rotor plate 56 without imparting shearing forces to the stub shaft 70 which could result in damage or misalignment of the components of rotor assembly 55.

The stop dog 81 is normally maintained in the chain line position 81' by a biasing mechanism, generally indicated by the numeral 95. The biasing mechanism 95 consists of a tension spring 96 that is interconnected between a hook eye block 97 affixed to stop dog 81 and an angle clip 98, which is selectively adjustably positionable on the rotor plate 56. The hook eye block 97 retains one end of spring 96. As shown, the angle clip 98 has an upstanding leg 99 with a bore 100 for receiving the other end of spring 96. The leg 101 of angle clip 98 overlying rotor plate 56 is provided with an elongate slot 102 (FIG. 2) for receiving a machine screw 103. By loosening the machine screw 103, the angle clip 98 may be adjusted to different positions on the rotor plate 56 in a direction generally axially of the spring 96. In this fashion, the tension applied to the stop dog 81 by biasing mechanism 95 can be varied to accommodate particular operating parameters.

In operation, the rolling door system 10 is actuated in conventional fashion to raise and lower the door 11 with the stop dog 81 maintained in the chain line position 81' as retained by the biasing mechanism 95. In the event of a system failure in the power system 20 or counterbalancing system which permits a faster than normal descent of the door 11, the attendant rotation of drive shaft 16 at an angular velocity in excess of its normal operating speed imparts increased centrifugal force to the stop dog 81 due to its rotation with the rotor plate 56. Once the centrifugal forces reach a value in excess of the preset tension provided by the biasing mechanism 95, the stop dog 81 swings outwardly and, in its counterclockwise rotation (as seen in FIG. 2), engages its curved contact surface 89 with the inner surface 47 of stator ring assembly 45, and subsequently engages a ramp 50 to direct tip 87 of stop dog 81 into a slot 48. In this respect, it is to be noted that with the 60-degree circumferential positioning of the slots 48, locking engagement of stop dog 81 with a slot 48 is effected within 60 degrees of the time that stop dog 81 is radially outwardly actuated, such that the door 11 is arrested by stop mechanism 40 before it can generate a sufficient velocity to damage components of the stop mechanism 40 or the rolling door system 10.

Once actuated, the stop mechanism 40 remains in the position with the stop dog 81 in the solid line position seen in FIGS. 2 and 3. When the failure which induced actuation of the stop mechanism 40 has been remedied, the door 11 may be mechanically raised to thereby reverse rotate drive shaft 16 through a few degrees, such that the tip 87 of stop dog 81 clears the return lip 49 of the slot 48 in which it was retained, at which time the spring 96 automatically returns stop dog 81 to the chain line position 81'. The rolling door system 10 is then fully operational until such time as a further failure might occur which would operate to actuate the stop mechanism 40.

Thus, it should be evident that the rolling door stop apparatus disclosed herein carries out various of the objects of the present invention set forth above and otherwise constitutes an advantageous contribution to the art. As will be apparent to persons skilled in the art, modifications can be made to the preferred embodiments disclosed herein without departing from the spirit of the invention, the scope of the invention being limited solely by the scope of the attached claims.

I claim:

1. A stop mechanism for a rolling door system having a drive shaft connecting a roll cylinder carrying door slats and a power system comprising, stator ring means mounted coaxially of the drive shaft, a plurality of circumferentially-spaced slot means positioned on the radially inner surface of said stator ring means, generally cylindrical rotor means mounted within said stator ring means for rotation with the drive shaft, cutout means in said rotor means, pivot means on said rotor means, stop dog means mounted on said pivot means for rotation thereon responsive to centrifugal force created by rotation of said rotor means, axial projection means on said stop dog means configured to engage said cutout means at one rotational limit of said stop dog means where said stop dog means effects locking engagement with said slot means, whereby said stop dog means transmits stopping forces from said stator ring means to said rotor means.

2. A stop mechanism according to claim 1, wherein said axial projection means is configured to engage said cutout means at the other rotational limit of said stop dog means where said stop dog means is in the normal operating position permitting free rotation of said rotor means.

3. A stop mechanism according to claim 2, wherein biasing means urges said stop dog means toward said other rotational limit of said stop dog means, whereby said stop dog means is maintained at said other rotational limit during the normal rotation of the drive shaft as controlled by the power system.

4. A stop mechanism according to claim 3, wherein said biasing means has adjustment means for varying the amount of centrifugal force operative on said stop dog means to move said stop dog means from said other rotational limit to said one rotational limit to stop said rotor means.

5. A stop mechanism according to claim 4, wherein said biasing means is a tension spring having one end thereof affixed to said rotor means and the other end thereof affixed to said stop dog means.

6. A stop mechanism according to claim 5, wherein one end of said tension spring is positioned by angle clip means which is adjustably positionable substantially axially of said torsion spring for varying the retaining force on said stop dog means and thus the amount of centrifugal force operative on said stop dog means to effect displacement from said other rotational limit to said one rotational limit.

7. A stop mechanism for a rolling door according to claim 1, wherein said slot means are substantially U-shaped openings in cross section angled in the direction of travel of said rotor means.

8. A stop mechanism for a rolling door according to claim 7, wherein said U-shaped openings form a return lip which precludes release of said stop dog means when positioned therein until rotation of said rotor means is reversed through an angular distance.

9. A stop mechanism for a rolling door according to claim 7, wherein said radially inner surface of said stationary ring has substantially linear ramps leading to said U-shaped openings.

10. A stop mechanism for a rolling door according to claim 7, wherein six of said U-shaped openings are equiangularly spaced about said stator ring means.

11. A stop mechanism for a rolling door according to claim 1, wherein said stop dog means has a circular surface having a radius substantially equal to the radius of said rotor means and a linear surface converging therewith to form a projecting tip for engagement with said slot means of said stator ring means.

12. A stop mechanism for a rolling door according to claim 11, wherein the extremity of said projecting tip is rounded for smooth engagement with said radially inner surface of said stator ring means and said slot means therein.

13. A stop mechanism for a rolling door according to claim 11, wherein said projecting tip has a curved contact surface proximate the extremity thereof for engaging linear ramp means leading to said spaced slot means.

14. A stop mechanism for a rolling door according to claim 12, wherein said curved contact surface is circular and has a radius substantially less than the radius of said rotor means.

15. A stop mechanism for a rolling door according to claim 1, wherein said pivot means is stub shaft means mounted on one face of said rotor means in proximity to said cutout means.

16. A stop mechanism for a rolling door according to claim 15, wherein pin means extends through said stub shaft for maintaining said stop dog means axially fixed but freely rotatably mounted relative to said stub shaft means.

17. A stop mechanism for a rolling door according to claim 1, wherein said rotor means is connected to the drive shaft for rotation therewith by a key and is affixed axially of the drive shaft by set screws.

18. A stop mechanism for a rolling door according to claim 1, wherein said stop dog means is a generally tear-drop-shaped plate having a circular end portion with extending sides tapering to form a tip for engaging said spaced slot means.

19. A stop mechanism according to claim 18, wherein said stop dog means has a bore positioned substantially centrally of said cylindrical end portion for mounting on a stub shaft of said pivot means, said cylindrical end being a substantially flat plate in overlying engagement with one face of said rotor means for controlled pivotal movement relative to said rotor means as a function of the rotational velocity thereof.

20. A stop mechanism for a rolling door according to claim 18, wherein the portion of said stop dog means bounded by said tapering sides and said tip is of substantially greater thickness than the thickness of said circular end portion for selectively extending into said cutout means and for controlling the extent of rotational movement of said stop dog means relative to said rotor means as a function of centrifugal force imparted to said stop dog means by the angular velocity of said rotor means.

* * * * *